US007370466B2

(12) United States Patent
Cai

(10) Patent No.: US 7,370,466 B2
(45) Date of Patent: May 13, 2008

(54) EXTENDED FLASHBACK ANNULUS IN A GAS TURBINE COMBUSTOR

(75) Inventor: Weidong Cai, Oviedo, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 553 days.

(21) Appl. No.: 10/984,526

(22) Filed: Nov. 9, 2004

(65) Prior Publication Data

US 2008/0078179 A1 Apr. 3, 2008

(51) Int. Cl.
*F23R 3/42* (2006.01)
*F23R 3/18* (2006.01)

(52) U.S. Cl. ..... 60/39.11; 60/748; 60/737

(58) Field of Classification Search ..... 60/737, 60/746, 747, 748, 39.11, 772; 431/346
See application file for complete search history.

(56) References Cited

U.S. PATENT DOCUMENTS

| | | | | |
|---|---|---|---|---|
| 4,429,527 | A | 2/1984 | Teets | |
| 4,982,570 | A | 1/1991 | Waslo et al. | |
| 5,274,995 | A * | 1/1994 | Horner et al. | 60/737 |
| 5,319,936 | A | 6/1994 | Ikeda et al. | |
| 5,408,825 | A | 4/1995 | Foss et al. | |
| 5,491,970 | A | 2/1996 | Davis, Jr. et al. | |
| 5,498,155 | A | 3/1996 | Chyou et al. | |
| 5,551,228 | A | 9/1996 | Mick et al. | |
| 5,623,826 | A | 4/1997 | Ohtsuka et al. | |
| 5,685,139 | A | 11/1997 | Mick et al. | |
| 5,822,992 | A | 10/1998 | Dean | |
| 5,983,642 | A | 11/1999 | Parker et al. | |
| 6,038,861 | A | 3/2000 | Amos et al. | |
| 6,038,864 | A | 3/2000 | Prade et al. | |
| 6,070,411 | A | 6/2000 | Iwai et al. | |
| 6,082,111 | A | 7/2000 | Stokes | |
| 6,282,904 | B1 | 9/2001 | Kraft et al. | |
| 6,237,860 | B1 | 12/2001 | Critchley | |
| 2001/0052229 | A1 | 12/2001 | Tuthill et al. | |
| 2002/0014078 | A1 | 2/2002 | Mandai et al. | |
| 2003/0037549 | A1 * | 2/2003 | Mandai et al. | 60/748 |
| 2004/0060297 | A1 | 4/2004 | Koenig et al. | |

FOREIGN PATENT DOCUMENTS

| | | | |
|---|---|---|---|
| JP | 411344224 | A | 12/1999 |
| JP | 2002-61842 | * | 2/2002 |

* cited by examiner

*Primary Examiner*—Ted Kim

(57) ABSTRACT

An extended flashback annulus (520) is formed between an exterior surface (506) of a shroud or casing (508) associated with a main swirler assembly inner body (500) or other fuel/air mixing device and the inner surface (514) of an annulus casting (510) which are in operational relationship with one another in a gas turbine combustor assembly. The extended flashback annulus (520) is capable of forming an extended protective cylindrical air barrier (550) that extends farther into the combustion zone, this barrier being more robust and providing for the reduction or prevention of flashback to the baseplate and other heat-susceptible upstream components.

23 Claims, 7 Drawing Sheets

EXTENDED FLASHBACK ANNULUS IN A GAS TURBINE COMBUSTOR

FIELD OF THE INVENTION

This invention relates to a combustion products generator, such as a gas turbine, having swirler-type fuel/air mixing apparatuses in an operational orientation with annulus casting housings so as to form a robust flow of air around the fuel/air mixture generated by each apparatus. This is effective in reducing the occurrence of undesired flashbacks.

BACKGROUND OF THE INVENTION

Combustion engines are machines that convert chemical energy stored in fuel into mechanical energy useful for generating electricity, producing thrust, or otherwise doing work. These engines typically include several cooperative sections that contribute in some way to this energy conversion process. In gas turbine engines, air discharged from a compressor section and fuel introduced from a fuel supply are mixed together and burned in a combustion section. The products of combustion are harnessed and directed through a turbine section, where they expand and turn a central rotor.

A variety of combustor designs exist, with different designs being selected for suitability with a given engine and to achieve desired performance characteristics. One popular combustor design includes a centralized pilot burner (hereinafter referred to as a pilot burner or simply pilot) and several main fuel/air mixing apparatuses, generally referred to in the art as injector nozzles, arranged circumferentially around the pilot burner. With this design, a central pilot flame zone and a mixing region are formed. During operation, the pilot burner selectively produces a stable flame that is anchored in the pilot flame zone, while the fuel/air mixing apparatuses produce a mixed stream of fuel and air in the above-referenced mixing region. The stream of mixed fuel and air flows out of the mixing region, past the pilot flame zone, and into a main combustion zone, where additional combustion occurs. Energy released during combustion is captured by the downstream components to produce electricity or otherwise do work.

In order to ensure optimum performance of a common combustor, it is generally preferable that the internal fuel-and-air streams are well-mixed to avoid localized, fuel-rich regions. As a result, efforts have been made to produce combustors with essentially uniform distributions of fuel and air. Swirler elements, for example, are often used to produce a stream of fuel and air in which air and injected fuel are evenly mixed.

Gas turbine technology has evolved toward greater efficiency and also to accommodate environmental standards in various nations. One aspect in the evolution of designs and operating criteria is the use of leaner gas air mixtures to provide for increased efficiency and decreased emissions of NOx and carbon monoxide. Combustion of over-rich pockets of fuel and air leads to high-temperature combustion that produces high levels of unwanted NOx emissions.

Also, a key objective in design and operation of gas turbine combustors is the stability of the flame and, related to that, the prevention of flashbacks. A flashback occurs when flame travels upstream from the combustion zone in the combustion chamber and approaches, contacts, and/or attaches to, an upstream component. Although a stable but lean mixture is desired for fuel efficiency and for environmentally acceptable emissions, a flashback may occur at times more frequently with a lean mixture, and particularly during unstable operation. For instance, the flame in the combustion chamber may progress backwards and rest upon for a period a baseplate which defines the upstream part of the combustion chamber. Less frequently, the flame may flash back into a fuel/air mixing apparatus, damaging components that mix the fuel with the air.

A multitude of factors and operating conditions provide for efficient and clean operation of the gas turbine combustor area during ongoing operation. Not only is the fuel/air mixture important, also relevant to gas turbine operation are the shape of the combustion area, the arrangement of assemblies that provide fuel, and the length of the combustor that provides varying degrees of mixing. Given the efficiency and emissions criteria, the operation of gas turbines requires a balancing of design and operational approaches to maintain efficiency, meet emission standards, and avoid damage due to undesired flashback occurrences.

The type of fuel/air mixing apparatus, and how it operates in relationship to other components, is one of the key factors in proper operation of current gas turbines. A common type of fuel/air mixing apparatus is known as a main swirler assembly (which also is referred to in the art as a nozzle, which is a more inclusive term). A main swirler assembly is comprised in part of a substantially hollow inner body that comprises stationary flow conditioning members (such as vanes) that create a turbulent flow. Fuel is added before or into this turbulent air stream and mixes to a desired degree within a period of time and space so that it is properly mixed upon combustion in the downstream combustion chamber. Also, in typical arrangements, a main swirler assembly also is comprised of an outer downstream element known as an annulus casting. An annulus casting surrounds a downstream section of the inner body, forming a channel for air flow known as the flashback annulus. In a typical arrangement, a quantity, such as eight, swirler assemblies are arranged circumferentially around the central pilot burner. The pilot burner burns a relatively richer mixture than is provided by the radially arranged swirler assemblies.

Various approaches to reduce or eliminate flashback in modern gas turbine combustion systems have been attempted. Since the prevention or elimination of flashbacks is a multi-factorial issue and also relates to various aspects of the design and operation of the gas turbine combustion area, a range of approaches has been attempted. These approaches often inter-relate with one another.

The present invention provides a solution toward obtaining an operationally stable, flashback-resistant main a fuel/air mixing apparatus, such as a swirler assembly, that provides an extended columnar air barrier that impedes the back progression of flame and, therefore, reduces or eliminates undesired flashback. More specifically, the present invention provides around the fuel/air mixture output of each main swirler assembly a more robust circumferential columnar body of air that 1) provides a fresh air barrier for a distance around the fuel/air mixture output of each respective main swirler assembly (or other source of fuel/air mixture); and 2) leans out the regions where there is a potential for flashback.

BRIEF DESCRIPTION OF THE DRAWINGS

The foregoing and other features of the invention will be apparent from the following more particular description of the invention, as illustrated in the accompanying drawings:

FIG. 2A also depicts the annulus casting of the main swirler assembly.

DETAILED DESCRIPTION OF THE INVENTION

The invention relates to formation and utilization of an improved channel, referred to herein specifically as a flashback annulus, through which flows air that surrounds an inner flow of fuel/air formed by swirler-type fuel/air mixing devices. Embodiments providing the improved channel as described and claimed herein provides a more robust surrounding air flow that better protects against occurrences of flashback by being more substantial and persisting in a protective form a greater distance into the combustion chamber. While the embodiments described below and depicted in the appended figures are illustrative of some forms of the invention, the full scope of the invention is not meant to be limited by these embodiments.

Figure 1A:
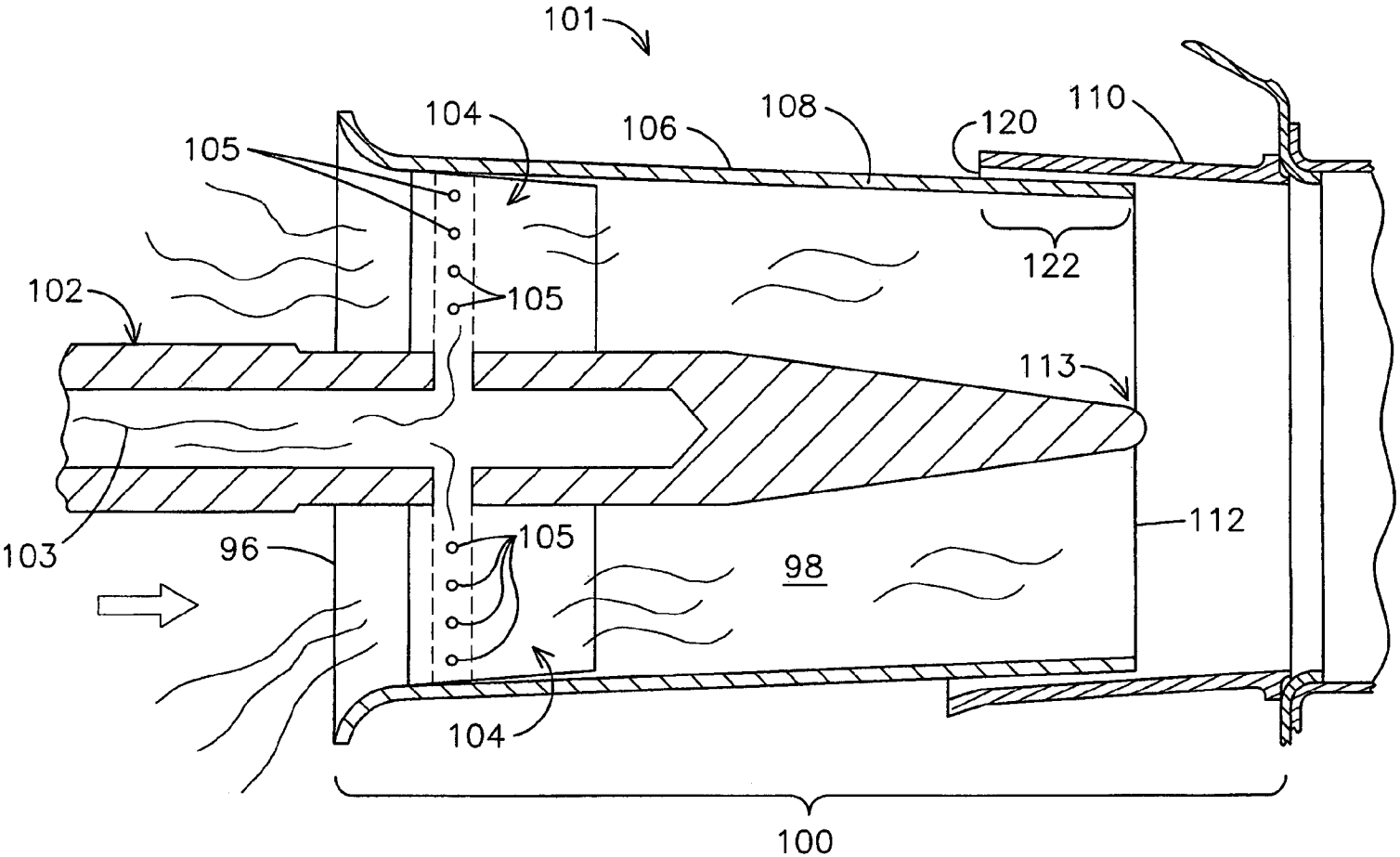
FIG. 1A PRIOR ART
FIG. 1A provides a side cross-sectional view of a prior art main swirler assembly comprising an inner body and a flashback annulus.

FIG. 1A provides a side cross-sectional view of a prior art main swirler assembly 100 comprising an inner body 101 and a flashback annulus 110, both of which are generally cylindrical. The direction of air flow during operation is indicated by an arrow. At the front end 96 of main swirler assembly inner body 101 are viewable swirler flow conditioning members 104 (common forms of which are referred to as vanes in the art) which impart turbulence upon the air flowing through the main swirler assembly inner body 101. An axis for air flow is defined by a path between an inner body front end 96 disposed upstream and an exhaust end 112 disposed downstream, and typically the swirler flow conditioning members are disposed angularly relative to this axis so as to create turbulence upon the air flowing through the swirler assembly inner body.

Fuel is supplied by way of a fuel delivery member 102 comprising a fuel supply passage 103 and a rocket-shaped end 113 (noting, however that embodiments of the fuel delivery member are referred to by some in the art as a "rocket" in its entirety). The fuel supply passage 103 is in fluid communication with a plurality of fuel exit ports 105 in the flow conditioning members 104 through which the fuel flows and is thereby dispersed into the flowing air through. The turbulence imparted by the flow conditioning members 104 provides for mixing of fuel and air in the hollow passage, or bore, 98 of the main swirler assembly inner body 101. The rod-like fuel delivery member 102 typically also provides-structural support, being attached to structural elements of a burner assembly (not shown), although often the inner body 101 also is attached and stabilized by other means.

A substantially cylindrical casing 108 having an outer surface surrounds and defines the bore 98 of the inner body 101. A flashback annulus 120 is the channel formed between a downstream section 122 of the casing 108 and the flashback annulus 110. The characteristics of the flashback annulus 120 is relevant both to the first discussion, on the state of the prior art, and also to disclosure of embodiments of the present invention.

Figure 1B:
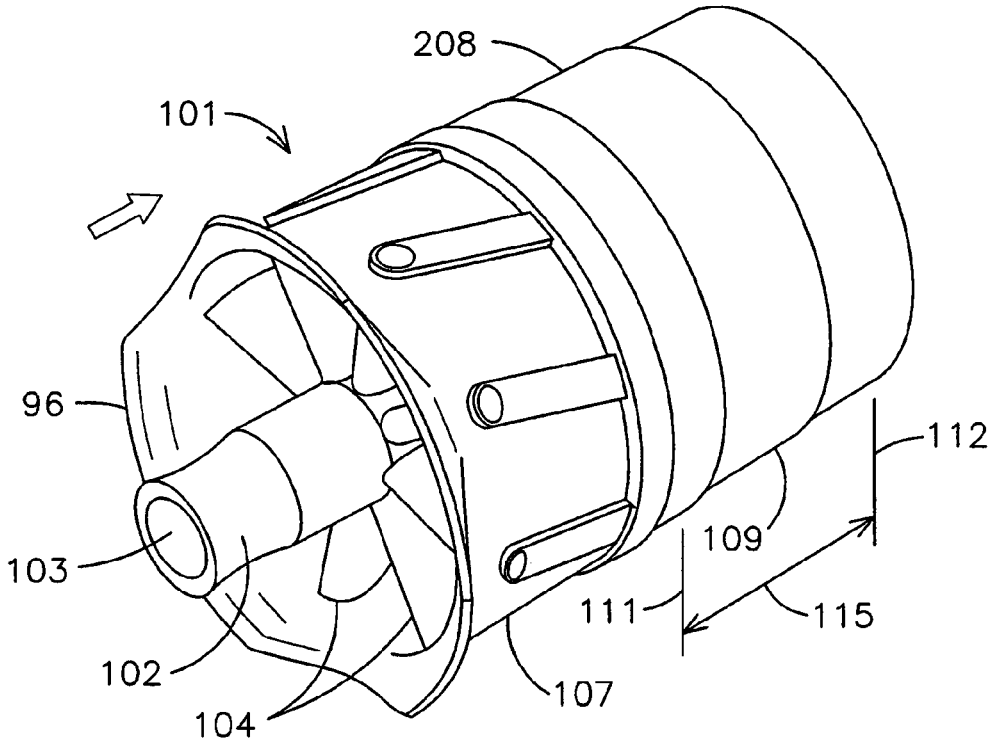
FIG. 1B PRIOR ART
FIG. 1B provides a side perspective view of a second embodiment of a prior art inner body of a main swirler assembly.

FIG. 1B provides a side perspective view of a prior art main swirler assembly inner body 101 that has somewhat different features than the inner body 101 of FIG. 1A. The direction of air flow during operation is indicated by an arrow. At the intake end 96 of main swirler assembly inner body 101 are viewable a plurality of swirler flow conditioning members 104 which, as noted, impart turbulence upon the air flowing through the main swirler assembly inner body 101. Fuel is supplied by way of fuel delivery member 102 comprising fuel supply passage 103. The fuel supply passage is in fluid communication with a plurality of fuel exit ports (not shown) in the flow conditioning members 104 through which the fuel flows and is thereby dispersed into the flowing air through.

Figure 1C:
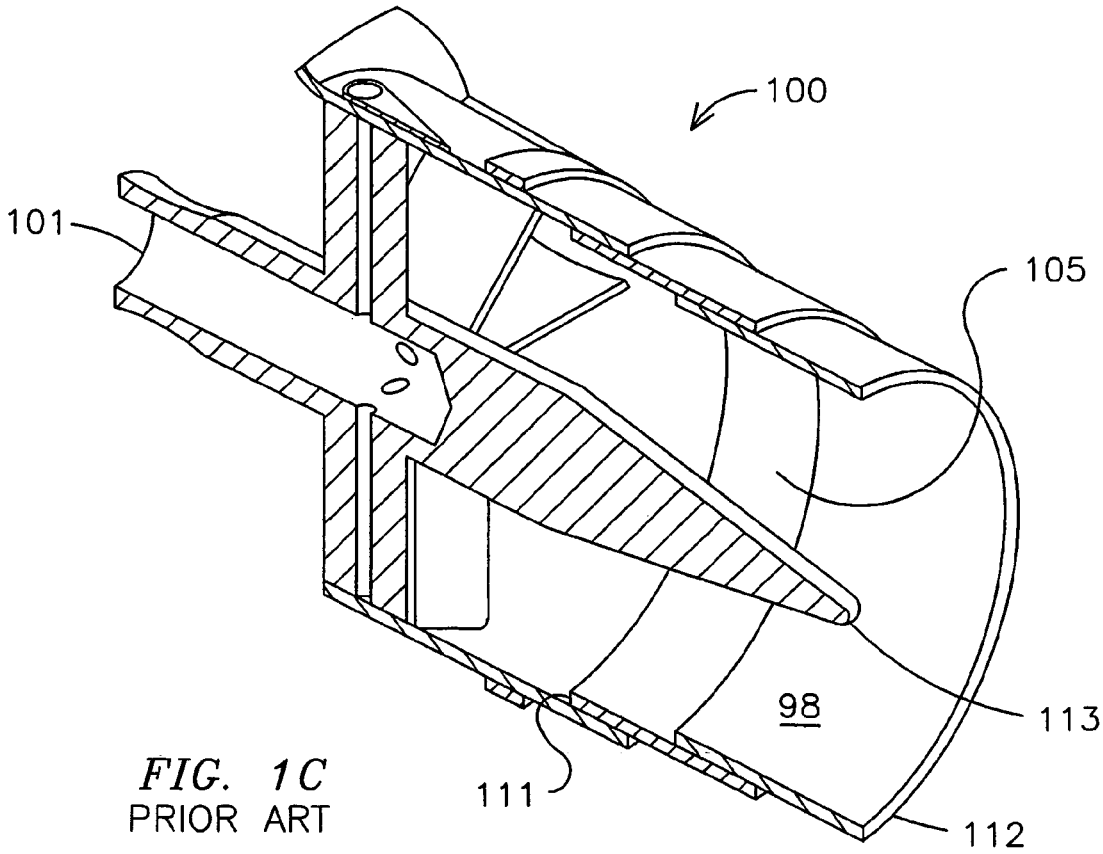
FIG. 1C PRIOR ART
FIG. 1C provides a cut-away view of the same prior art main swirler assembly inner body as depicted in FIG. 1B.

In the embodiment depicted in FIG. 1B, a cylindrical casing 108 of main swirler assembly inner body 101 is comprised of an upstream body 107 and a downstream shroud 109. The downstream shroud 109 has a length 115 defined as the distance between a front end 111 disposed upstream and an exhaust end 112 disposed downstream (this exhaust end being the same as the exhaust end 112 of the entire inner body 101). A section of the downstream shroud 109 toward and up to the exhaust end 112 forms one side of the flashback annulus (not shown in FIG. 1B) through which air flows to reduce or eliminate flashback. FIG. 1C provides a cut-away view of the main swirler assembly inner body 101, showing the rocket-shaped end 113 of the fuel delivery member 102, and providing a perspective view of the open inner space, or bore 98 of the main swirler assembly inner body 101.

Although the discussion of certain examples herein, such as the embodiment depicted in FIGS. 1B and 1C, describes a main swirler assembly inner body comprising an upstream body or shroud and a downstream shroud, it is appreciated that a main swirler assembly inner body that has a unitary shroud, or that has more than two components, may be used in the present invention. In such cases, it is the relevant section(s) of the outer shroud(s) that is/are contained within the annulus casting upon alignment with the annulus casting in an operational relationship, that provides an inner surface that helps define the flashback annulus channel. Thus, unless more specifically described as a downstream shroud, the terms "main swirler assembly shroud," "swirler assembly shroud," and "shroud" are taken to mean the one or more components forming the outer surface of the main swirler assembly inner body, which includes the downstream section that forms the flashback annulus channel when in operational relationship with the flashback casting. As used herein, the term shroud is meant to mean an integral or fixedly attached component of the main swirler assembly inner body.

More generally, a shroud is but one type of casing surrounding the bore of the main swirler assembly inner body. One example of a unitary casing is in FIG. 1A. Without being limiting, some main swirler assembly casings may be independent components, such as cylindrical sleeves, into which are inserted the functional above-described components of the main swirler assembly inner body. In such embodiments it is a downstream section of the exterior surface of the main swirler assembly casing that defines, in cooperation with the opposing interior surface of the annulus casting, the channel identified as the flashback annulus. As for the downstream shroud described above, a swirler assembly casing has a length defined as the distance between a front end disposed upstream and an exhaust end disposed downstream.

Figure 2A:
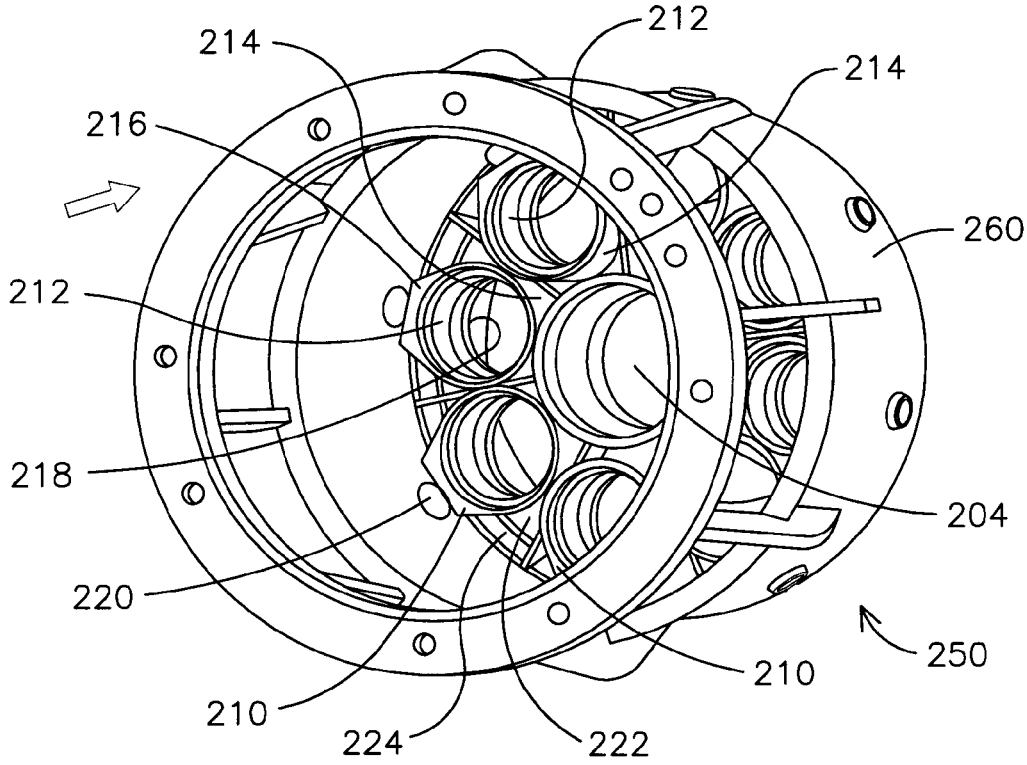
FIG. 2A PRIOR ART
FIG. 2A provides a side perspective view of a combustor assembly that accommodates eight main swirler assembly inner bodies, such as the one depicted in FIGS. 1B and 1C.

FIG. 2A provides a side perspective view of a combustor assembly 250, which accommodates eight of the swirler assemblies (inner bodies of which are not shown). The direction of air flow during operation is indicated by an arrow. Each main swirler assembly inner body is arranged to fit within an annulus casting 210. Each annulus casting 210 has an inner surface 212, an outer surface 214, an upstream end 216, a downstream end 218, and a stabilizing shaft 220 by which it is attached to the combustor shell 260, such as by welding. Further as to the combustor assembly 250, the center hole, 204, is for air to the central pilot (not shown).

The use of the term "casting" in "annulus casting" is a term of art and is not meant to limit the method of fabrication of the annulus casting. For instance, an annulus casting may be fabricated by casting, by forging, by welded assembly, or by other methods known in the art.

Figure 2B:
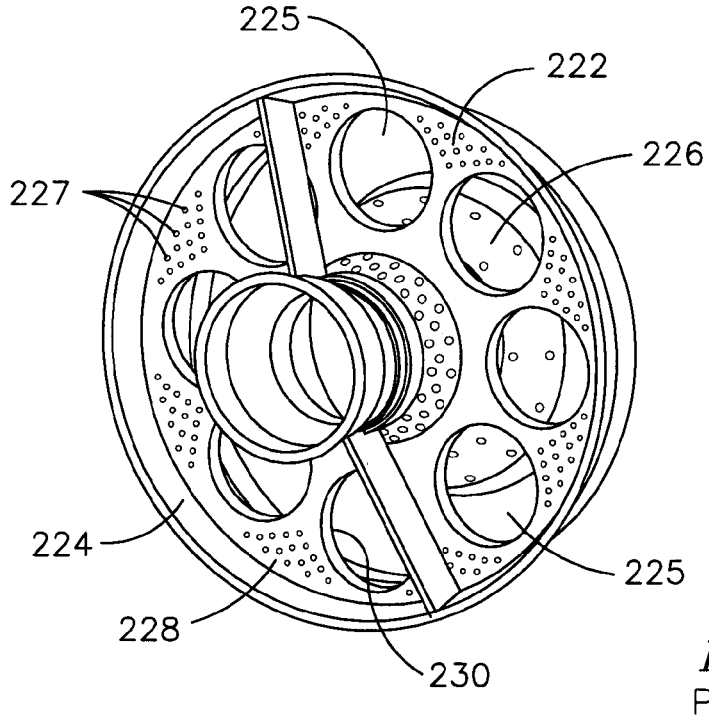
FIG. 2B PRIOR ART
FIG. 2B provides perspective view of a portion of combustor assembly of FIG. 2A showing a baseplate and a pilot shroud.

FIG. 2B provides another view of a portion of the combustor assembly 250 of FIG. 2A, showing baseplate 222 and the pilot shroud 226. The baseplate 222 receives and is welded to, otherwise affixed to, or tightly fits with the downstream end of the annulus castings (not shown in FIG. 2B). An annulus casting downstream end 218 is positioned in each of the eight main swirler assembly openings 225 of baseplate 222. The baseplate 222 also is shown with a plurality of ventilation holes 227 through which air passes into the combustion chamber (not shown). The position of the baseplate is viewable also in FIG. 2A, and the structure of the angled edge 224 of the baseplate also is depicted in both FIGS. 2A and 2B. When in operation relationship at the upstream end of the combustor chamber, the baseplate 222 has an upstream plane 228 and a downstream plane 230 (more clearly viewed in FIG. 4).

Figure 2C:
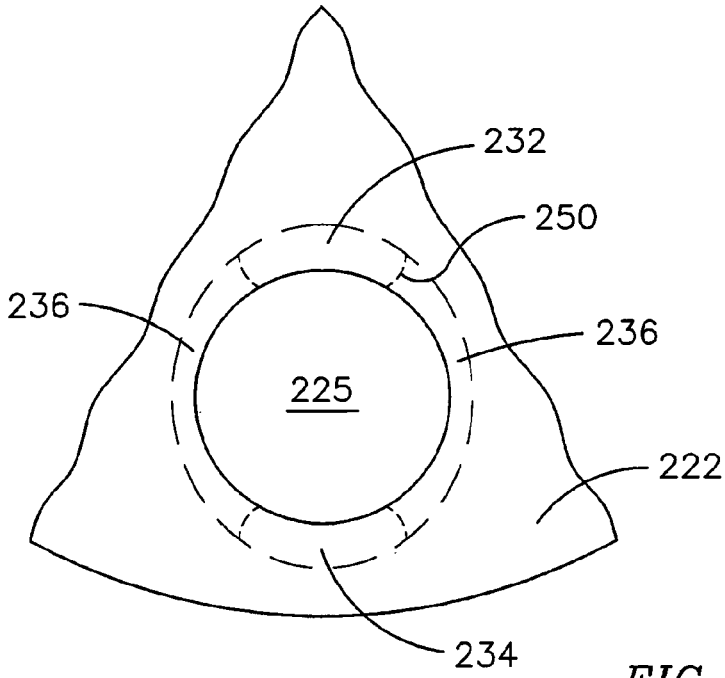
FIG. 2C PRIOR ART
FIG. 2C provides an enlarged view of portion of the baseplate, depicting a high-flashback-occurrence zone around one opening for a main swirler assembly.

FIG. 2C provides an enlarged view of portion of the baseplate 222 depicting a high-flashback-occurrence zone 250 around one baseplate opening 225 for a main swirler assembly (however, not depicting ventilation holes 227). This zone 250 is that part of baseplate 222 between the large dashed lines and opening 225. This zone 250 is considered to comprise a part of the baseplate 222 that receives a substantially high and disproportionate amount and/or severity of flashbacks based on observations of baseplates that have been in gas turbines under routine operation. In such circumstances this zone 250 has been observed to have discoloration and, at times, cracks and other signs of structural damage attributed to flashback occurrence (not shown in FIG. 2C). More particularly, and based on these indicia of flashback occurrence, it has been observed that an inboard area 232 and an outboard area 234 of the zone 250 (demarcated by the small dashed lines) experience relatively higher amounts and/or severity of flashbacks than the side areas 236 of zone 250. Thus, it has been observed that structural damage occurs more frequently in inboard area 232 and in outboard area 234 compared to side areas 236. Accordingly, regions in which such structural damage is found (not shown in FIG. 2C) exist within areas 232 and 234, and less frequently in side areas 236. Without being bound to a particular theory, these regions of structural damage are believed due to one or both of: a) an increased number of flashbacks impinging on or near such a region; b) structural weakness of such a region, such as may be due to thermal stress and/or other factors. As discussed below, various embodiments of the present invention are effective to reduce the total area of these regions of structural damage.

Figure 3:
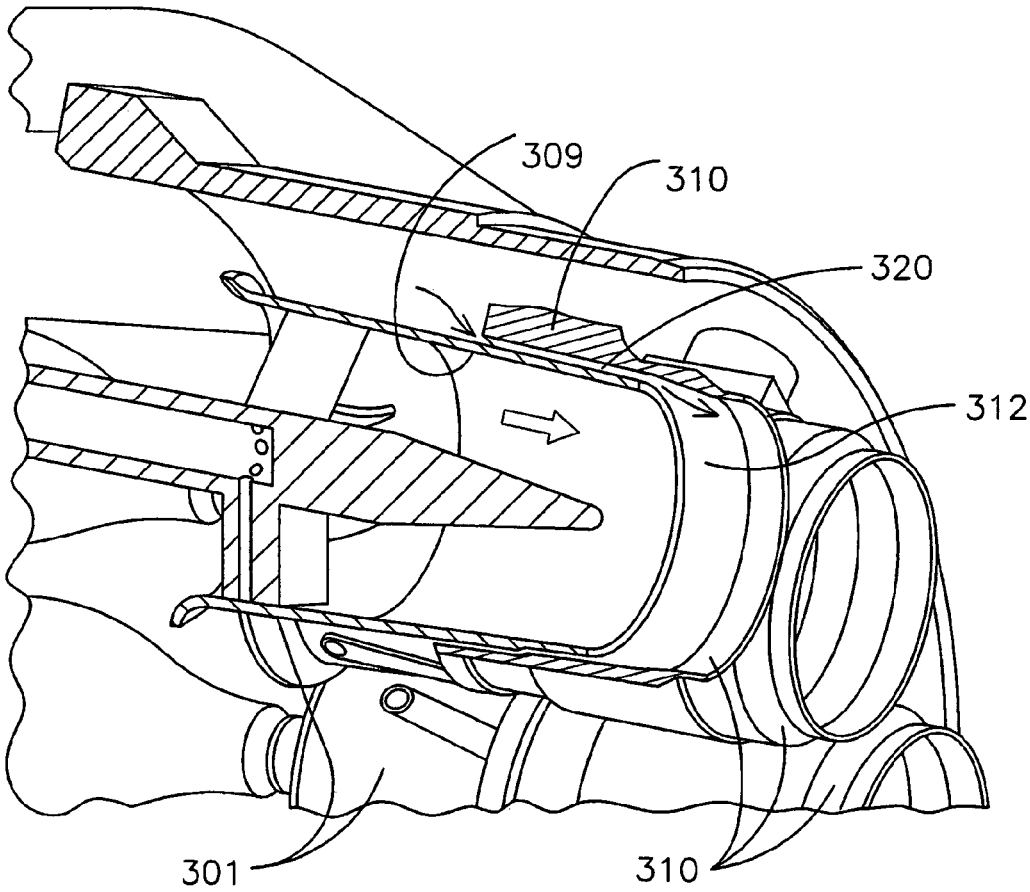
FIG. 3 PRIOR ART
FIG. 3 provides a side perspective view, with cut-away components, of prior art swirler assembly inner bodies fit within respective annulus castings.

As referred to in the art, a burner assembly comprises a number of main swirler assembly inner bodies, each one positioned to fit into one of the annulus castings such as shown in FIG. 2A. FIG. 3 provides a side perspective view, with cut-away components, of prior art swirler assembly inner bodies 301 fit within respective annulus castings 310. That is, this represents a partial view of a burner assembly positioned in its operational relationship with the combustor assembly. A large arrow indicates the general direction of air flow, and the small arrows indicate flow of air through a flashback annulus, 320. In the depicted embodiment the flashback annulus 320 is the channel formed between the outer surface of the downstream section of the downstream shroud 309 that is opposing the inner surface 312 of the annulus casting 310.

Typically, tabs or other protruding spacing structures (not shown) are positioned between and contact both the outer surface of the downstream shroud 309 and the inner surface of the annulus casting 310 at points within the flashback annulus, 320. These spacing structures establish a width of the flashback annulus and provide structural support during operation by passing load from one component to the other. Notwithstanding these spacing structures, which occupy a small percentage of the volume of the flashback annulus 320, the airflow produced in the flashback annulus 320 assumes and retains for a certain distance downstream a generally hollowed cylindrical shape (i.e., a hollow column) due to the cross-sectional circular shape of the flashback annulus 320. As this air column encounters objects, such as the pilot shroud, and other air currents, it is subject to deformation from its original shape.

During operation of the combustor, the central pilot provides a constant flame, albeit often of a richer fuel/air mixture to assure its continuity. Each of the swirler assemblies emits a fuel/air mixture that enters the combustion chamber and becomes ignited. As the fuel/air ratio of the fuel/air mixture from these swirler assemblies is made leaner, which is done for efficiency and/or to meet environmental standards for emissions, the combustion system tends to become less stable. Under such conditions, and based on a number of variables including combustion dynamics that typically are in flux, a flashback of the flame to the baseplate may occur. Over time, repeated occurrence of flashbacks to the baseplate, or less frequently to components within the main swirler assembly inner body, may damage the baseplate and other components as these are not designed for repeated direct exposure to flame temperature.

As inferable from the nomenclature, a major purpose of the air flowing through the flashback annulus 320 is to discourage flashback occurrence. The basis for this is that a cylindrical column of air released from the flashback annulus 320 serves as a barrier, for a distance, to prevent the flames in the combustor from 1) contacting the fuel/air mixture within it (from the respective main swirler assembly inner body) until that fuel/air mixture is sufficiently downstream in the combustor chamber and/or 2) moving backwards (i.e., upstream, toward the baseplate) either exteriorly of the normal path of the main fuel/air flows from the swirler assemblies or interiorly, between the pilot flame and the swirler assemblies.

However, under certain combinations of conditions with the prior art swirler assemblies in operational orientation with respective annulus castings (such as depicted in FIG. 3), some flashbacks may nonetheless occur. In part, this is believed to be related to the design and the dynamics found in prior art configurations.

More particularly, while not being bound to a particular theory, it is believed that the prior art operational relationship between a main swirler assembly inner body and an annulus casting results in inadequate development, and in degradation of, the cylindrical column of air for one or more of the following reasons. To exemplify this is FIG. 4, a side cross-sectional view of a prior art main swirler assembly inner body 401 in operational relationship with an annulus casting 410, which together comprise a main swirler assembly 400 and form a flashback annulus 420. While not critical to the following reasoning, it is noted that main swirler assembly inner body 400 comprises a single cylindrical sleeve 408 instead of the upstream body 107 and a downstream shroud 109 of FIG. 1B. The exterior of a downstream section 422 of this cylindrical sleeve comprises an interior side of the flashback annulus 420. Also, relevant to later discussion, the length 430 of the annulus casting 410 is defined as the distance between an upstream end 416 and a downstream end 418 of the annulus casting 410.

As to the reasons, first, when the air flows through the relatively short flashback annulus 420, due to the relatively short length of this passage, the air flow at the exit point 442 has not yet attained a high degree of laminarity. As such, it is more likely to deteriorate upon exposure to disruptive air currents 452 that are generated within the hollow bore 405 of the main swirler assembly inner body 401. Thus, along section 446 of the annulus casting 410 there is substantial deterioration of the cylindrical column of air 448 (depicted in cross section in FIG. 4).

Figure 4:
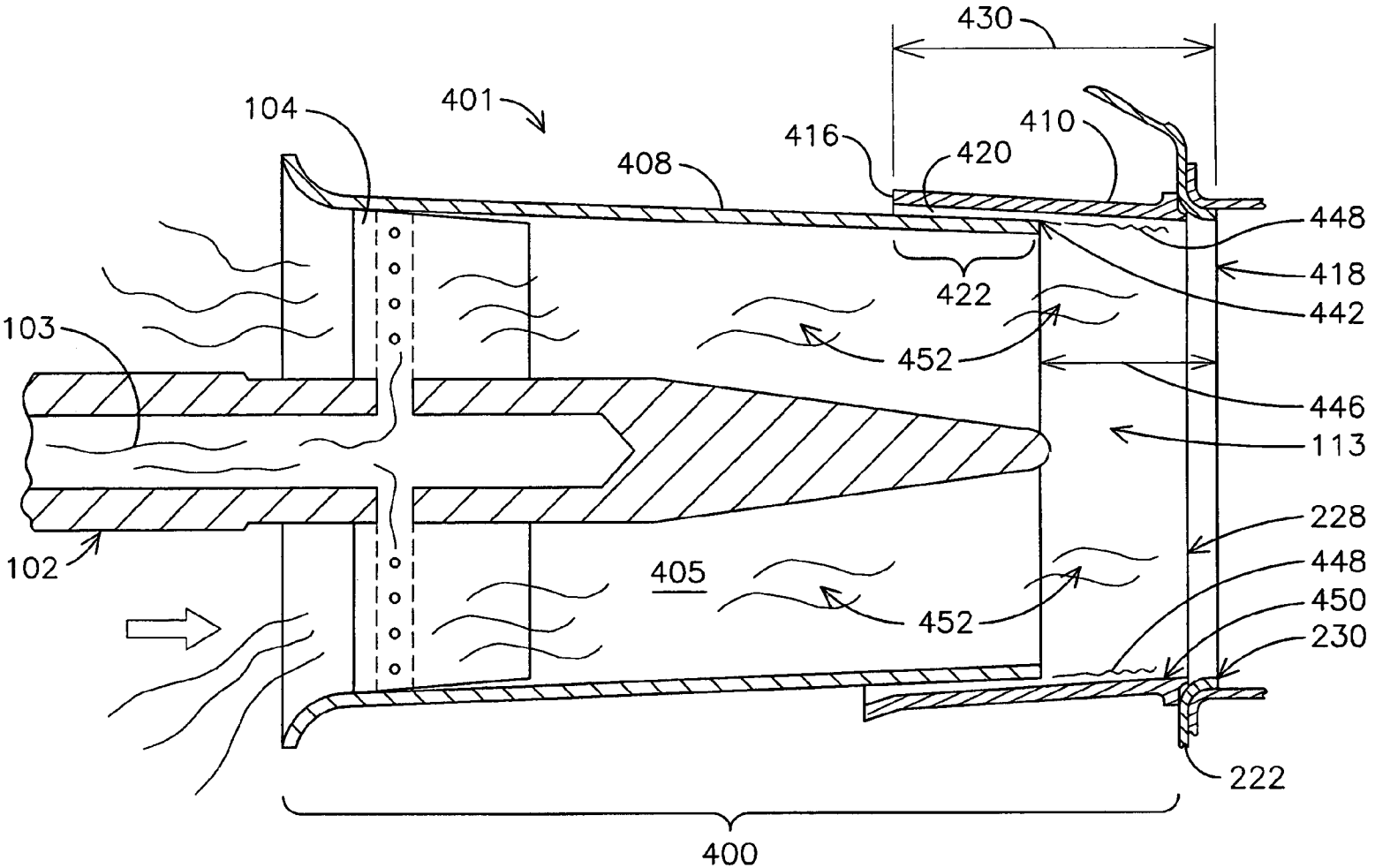
FIG. 4 PRIOR ART
FIG. 4 provides a side cross-sectional view of the prior art main swirler assembly inner body in operational relationship with the flashback annulus of FIG. 1A, and depicts hypothesized air flow phenomenon.

Second (and selectively independent of or in combination with the first reason), it is believed that the frictional differential along section 446, where there is a solid wall 450 on one side of the cylindrical column of air 448 and the relatively turbulent air currents 452 on the other side, contribute to the deterioration of the cylindrical column of air 448. This may be partly related to the loss of laminar flow as the air closest to the wall 450 is slowed due to frictional losses. Simultaneously, the cylindrical column of air 448 farther from this wall is perturbed by relatively turbulent air currents 452 that are directed outwardly from the main swirler assembly bore's center. These relatively turbulent air currents 452 may also either slow or speed up one side of the cylindrical column of air 448, depending on the relative speeds of the meeting air flows. Further, even if these disruptive air currents 452 are slower than the cylindrical column of air 448, the turbulence of these disruptive air currents 452 is expected to create eddies (not shown) that are not synchronous with the effect of the frictional loss of the solid wall 450. Thus, even under this circumstance, degradation of the cylindrical column of air 448 is expected to occur in the prior art arrangement of elements as depicted in FIG. 4. More generally as to this second reason, it is appreciated that when there is a longer flashback annulus 420 so there is less disturbance from and mixing with the fuel/air mixture in the bore of the main swirler assembly, the result is a more protected cylindrical column of air 448.

In addition, appreciating the complexity of the range of combinations of conditions that may lead to instability in modern turbine systems, where that instability may lead to a flashback, has contributed to the present invention. Further, recognizing the importance of maintaining a more robust protective air cylindrical column around the fuel/air mixture from the swirler assemblies, and maintaining this for a longer distance into the combustion chamber, has contributed to the present invention.

Figure 5:
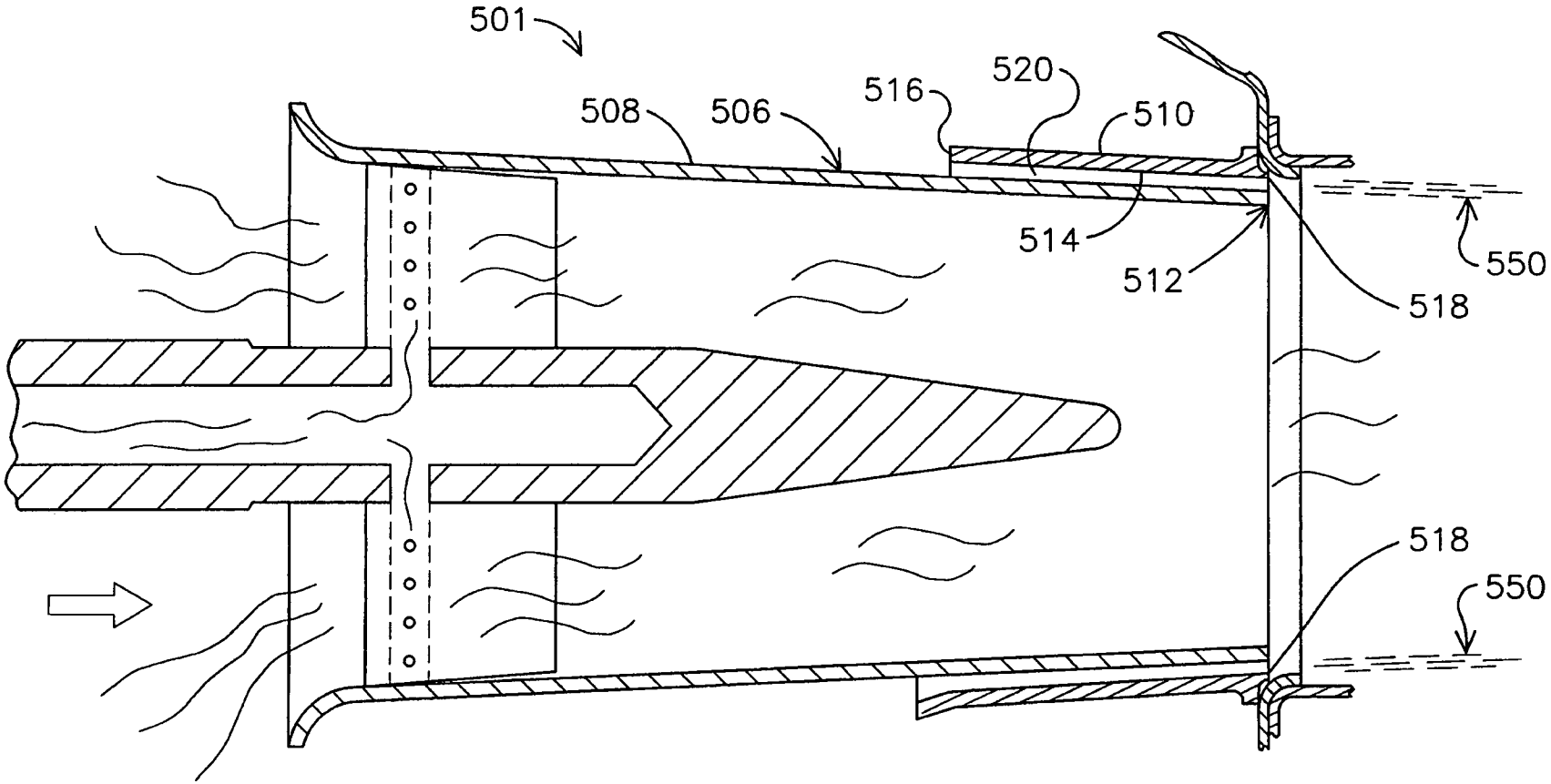
FIG. 5 provides a cut-away side view of the end of a main swirler assembly inner body in operational relationship to a respective flashback annulus that shows one embodiment of the present invention.

In comparison to the above-described prior art, in various embodiments of the present invention the length of the flashback annulus is extended so that it ends closer to the downstream end of the annulus casting. This provides the desired characteristics of a more robust protective air cylindrical column downstream of the main swirler assembly. One embodiment following this approach to the present invention is depicted in FIG. 5. FIG. 5 is a cut-away side view of the end of a main swirler assembly inner body 501 that shows the exhaust end 512 of the cylindrical sleeve 508 extending to meet the downstream end 518 of the annulus casting 510. This extends the flashback annulus 520, formed between the exterior surface 506 of the sleeve 508 and the inner surface 514 of the annulus casting 510 from the upstream end 516 to the downstream end 518 of the annulus casting 510. This results in the formation of an extended protective cylindrical air barrier 550.

Figure 6:
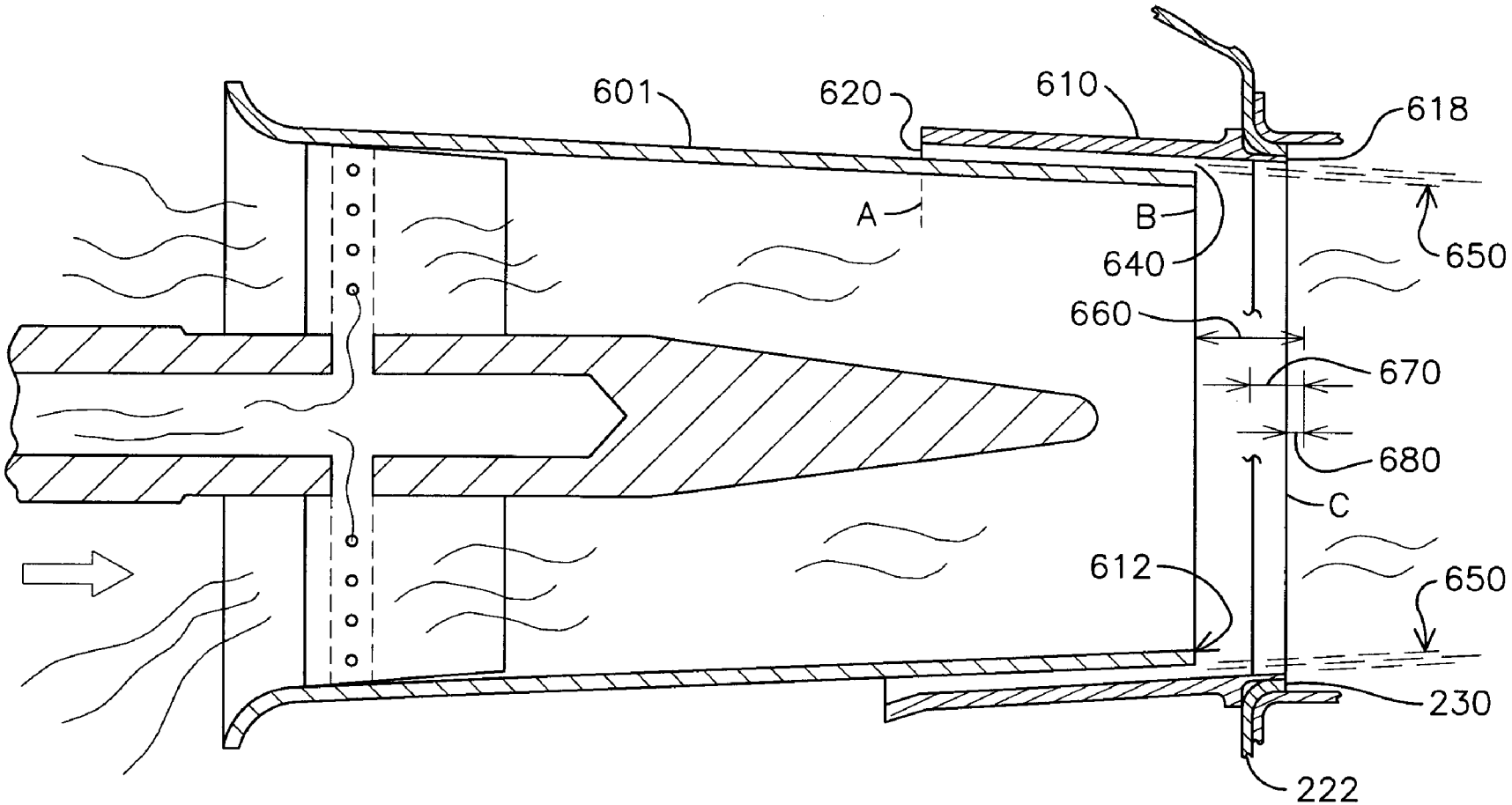
FIG. 6 provides a cut-away side view of the end of a main swirler assembly inner body in operational relationship to a respective flashback annulus that shows several ranges of relationships that define various embodiments of the present invention.

FIG. 6 exemplifies other embodiments of the present invention for generation of an extended protective cylindrical air barrier 650. Considering the arrangement of components in FIG. 6, an extended protective cylindrical air barrier is defined as a hollow cylinder of air generated from a flashback annulus channel that extends for at least 75 percent of the length of the annulus casting 610. That is, a minimum-length flashback annulus that is effective to form the extended protective air barrier extends from point "A" to point "B," that is, extends 75 percent of the total length of annulus casting 610 (shown as the distance between points "A" and "C"). As such, the resulting extended protective cylindrical air barrier 650 is more persistent downstream of the flashback annulus downstream end 640, and it possesses increased resilience and resistance to flashback. The protective effect afforded by an extended protective cylindrical air barrier lasts for a greater axial distance downstream of the baseplate than occurs in prior art configurations. In prior art configurations, the exhaust end of the main swirler assembly shroud is positioned upstream of the annulus casting downstream end at between about 50 and 60 percent of the length of the annulus casting (see, for example, FIGS. 1A and 4).

More generally, for certain embodiments of the present invention the exhaust end of the main swirler assembly shroud is disposed further downstream than that of the prior art, being positioned between about 25 percent of the annulus casting length upstream of, and about 5 percent of the annulus casting length downstream of, the annulus casting downstream end 618. This span is depicted in FIG. 6 as span 660. Further, in certain embodiments, the main swirler assembly shroud exhaust end 612 is positioned between about 10 percent of the annulus casting length upstream of, and about 5 percent of the annulus casting length downstream of, the annulus casting downstream end 618. This span is depicted in FIG. 6 as 670. In other embodiments, the main swirler assembly shroud exhaust end 612 is positioned between (and including) alignment with the annulus casting downstream end 618, and about 5 percent of the annulus casting length downstream of the annulus casting downstream end 618. This span is depicted in FIG. 6 as span 680. Embodiments within this span, in many instances, extend downstream of the downstream plane 230 of the baseplate 222.

These embodiments provide for the formation of an extended protective cylindrical air barrier that provides for a more persistent, more robust barrier that reduces or prevents the occurrence of flashback, depending on the operating conditions and other design factors. That is, and more generally, embodiments of the present invention are effective to form an extended protective cylindrical air barrier within a channel formed between the downstream shroud and the annulus casting, which results in production of an extended protective cylindrical air barrier that is effective to eliminate or substantially lower the frequency of flashbacks in the high-flashback-occurrence zone around baseplate openings for main swirler assemblies (see FIG. 2C). Concomitant with this, various embodiments of the present invention are effective to reduce the overall area of the regions of structural damage that are located in the high-flashback-occurrence zone.

It is appreciated that the present invention may be effectuated with designs and arrangements of components that differ from those described and depicted above. As but one example, a single sleeve may be used to house a set of swirler vanes mounted on a rod-like fuel delivery member, where the sleeve is positioned to encompass the vanes but is not contacting them. This sleeve is in operational orientation with a surrounding annulus casting to form an extended flashback annulus, in accordance with the above descriptions and definitions. This results in production of an extended protective cylindrical air barrier.

Other examples include where the fuel is not supplied from orifices in the vanes of a main swirler assembly inner body, but are instead dispersed into the air flow from orifices upstream of the main swirler assembly inner body, by pegs within the bore of the main swirler assembly inner body, or from orifices (i.e., nozzles) positioned further downstream of the flow conditioning members, such as along the end, rocket section of the rod. Accordingly, the present invention is not limited to the particular embodiments and design and arrangement of components described herein. For example, embodiments of the present invention include embodiments of swirler assembly inner bodies that lack fuel delivery members as described herein.

Also, other approaches to increasing the robustness and effectiveness of the extended protective cylindrical air barrier may be used in combination with the present invention. For example, the gap, or space between the outside surface of the swirler assembly shroud and the inside surface of the annulus casting, is about 1.2 millimeters in certain prior art apparatuses. This gap may be widened to provide for additional air flow to form a more robust, more effective protective cylindrical air barrier. One way to widen this gap is to fabricate a swirler assembly shroud with a relatively smaller diameter, thereby leaving more space between it and the annulus casting. Another way is to provide a redesigned annulus casting with a larger inside diameter. These two approaches also may be effectuated in combination with one another. In making such changes, the upstream supply and its distribution are attended to in order to assure that sufficient air flow and pressure are available for entry into the flashback annulus, so that widening the flashback annulus does not merely result in a weaker protective cylindrical air barrier. Also, a wider flashback annulus may, in some embodiments, result in a design that permits a relatively shorter length of the flashback annulus. Embodiments of extended and/or protected flashback annuluses that employ such approaches are considered within the scope of the present invention.

It should be understood that the examples and embodiments described herein are for illustrative purposes only and that various modifications or changes in light thereof will be suggested to persons skilled in the art and are to be included within the spirit and purview of this application and the scope of the appended claims.

I claim as my invention:

1. In a gas turbine combustor, a main swirler assembly comprising an inner body and an annulus casting, the inner body comprising a main swirler assembly casing having an upstream front end and a downstream exhaust end defining a length and a plurality of swirler flow conditioning members arranged within a bore defined by the casing, and the annulus casting having a length defined by a distance between an upstream end and a downstream end, the annulus casting length being significantly shorter than the swirler casing length, the downstream end adapted to contact a baseplate, the baseplate comprising high-flashback-occurrence zones adjacent an opening into which fits the downstream end, a downstream section of the casing in substantially concentric cylindrical alignment within the annulus casting to define a flashback annulus, the main swirler assembly casing exhaust end positioned between about 25 percent of the annulus casting length upstream of, and about 5 percent of the annulus casting length downstream of, the annulus casting downstream end, wherein flow through the flashback annulus is effective to reduce, in total area, regions of structural damage located in the high-flashback-occurrence zones.

2. The apparatus of claim 1, the main swirler assembly casing comprising a main swirler assembly shroud.

3. The apparatus of claim 1, the main swirler assembly inner body additionally comprising a fuel delivery member having a fuel supply passage in fluid communication with a plurality of fuel exit ports disposed in said inner body.

4. The apparatus of claim 1, the main swirler assembly casing exhaust end positioned between about 10 percent of the annulus casting length upstream of, and about 5 percent of the annulus casting length downstream of, the annulus casting downstream end.

5. The apparatus of claim 4, the main swirler assembly casing comprising a main swirler assembly shroud.

6. The apparatus of claim 1, the main swirler assembly casing exhaust end aligned with the annulus casting downstream end.

7. The apparatus of claim 6, the main swirler assembly casing comprising a main swirler assembly shroud.

8. The apparatus of claim 1, the main swirler assembly casing exhaust end positioned between alignment with the annulus casting downstream end, and about 5 percent of the annulus casting length downstream of the annulus casting downstream end.

9. The apparatus of claim 8, the main swirler assembly casing comprising a main swirler assembly shroud.

10. The apparatus of claim 8, the main swirler assembly casing exhaust end extending downstream of the downstream plane of the baseplate.

11. The apparatus of claim 10, the main swirler assembly casing comprising a main swirler assembly shroud.

12. In a gas turbine combustor comprising a main swirler assembly inner body in operational relationship with an annulus casting having a length defined by a distance between an upstream end and a downstream end, the downstream end adapted to contact a baseplate, the baseplate comprising high-flashback-occurrence zones adjacent an opening into which fits the downstream end, a main swirler assembly casing having an upstream front end and a downstream exhaust end defining a length, and a downstream section of the casing in substantially concentric cylindrical alignment within the annulus casting to define a flashback annulus, the exhaust end positioned between about 25 percent of the annulus casting length upstream of, and about 5 percent of the annulus casting length downstream of, the annulus casting downstream end, the annulus casting length being significantly shorter than the swirler casing length, wherein flow through the flashback annulus is effective to reduce, in total area, regions of structural damage located in the high-flashback-occurrence zones.

13. For a gas turbine combustor, a main swirler assembly comprising an inner body in operational relationship with an annulus casting, the main swirler assembly inner body comprising a generally cylindrical casing having an axis for air flow defined by a path between a front end disposed upstream and an exhaust end disposed downstream and defining a length, the casing enclosing a plurality of swirler flow conditioning members disposed angularly relative to the axis to create turbulence upon the air flowing through the main swirler assembly inner body, and a rod-shaped fuel delivery member attached centrally to the plurality of swirler flow conditioning members, and having outlets for the dispersal of fuel into the air flow, and the annulus casting having a length defined by a distance between an upstream end and a downstream end, the downstream end adapted to contact a baseplate, the baseplate comprising high-flashback-occurrence zones adjacent an opening into which fits the downstream end, a downstream section of the casing in substantially concentric cylindrical alignment within the annulus casting to define a flashback annulus, the exhaust end of the casing positioned between about 25 percent of the annulus casting length upstream of, and about 5 percent of the annulus casting length downstream of, the annulus casting downstream end, the annulus casting length being less than one half of the swirler casing length, wherein flow through the flashback annulus is effective to reduce, in total area, regions of structural damage located in the high-flashback-occurrence zones.

14. The apparatus of claim 13, the exhaust end of the casing positioned between about 10 percent of the annulus casting length upstream of, and about 5 percent of the annulus casting length downstream of, the annulus casting downstream end.

15. The apparatus of claim 13, the exhaust end of the casing aligned with the annulus casting downstream end.

16. The apparatus of claim 13, the exhaust end of the casing positioned between alignment with the annulus casting downstream end, and about 5 percent of the annulus casting length downstream of the annulus casting downstream end.

17. A plurality of main swirler assemblies and respective annulus castings of claim 13 arranged circumferentially in a combustor shell to which are fixedly attached the plurality of annulus castings, the combustor shell comprising structure for installation into a gas turbine combustor.

18. A gas turbine combustor comprising a plurality of main swirler assemblies of claim 13, a combustor shell surrounding the plurality of main swirler assemblies, and a baseplate disposed at a downstream end of the combustor shell and contacting the downstream end of each of the annulus castings of said plurality of main swirler assemblies.

19. An extended flashback annulus in a gas turbine combustor defined by a downstream section of a main swirler assembly casing having an upstream front end and a downstream exhaust end defining a length in operational relationship with an annulus casting, the annulus casting having a length defined by a distance between an upstream end and a downstream end, the annulus casting length being less than one half of the swirler casing length, the downstream end adapted to contact a baseplate, the baseplate comprising high-flashback-occurrence zones adjacent an opening into which fits the downstream end, the main swirler assembly casing having a front end disposed upstream and an exhaust end disposed downstream and enclosing a plurality of swirler flow conditioning members disposed angularly to create turbulence upon air flowing therethrough, the downstream section of the casing in substantially concentric cylindrical alignment within the annulus casting to define the extended flashback annulus, the exhaust end positioned between about 25 percent of the annulus casting length upstream of, and about 5 percent of the annulus casting length downstream of, the annulus casting downstream end, wherein flow through the flashback annulus is effective to reduce, in total area, regions of structural damage located in the high-flashback-occurrence zones.

20. The apparatus of claim 19, the exhaust end of the casing positioned between about 10 percent of the annulus casting length upstream of, and about 5 percent of the annulus casting length downstream of, the annulus casting downstream end.

21. The apparatus of claim 19, the exhaust end of the casing aligned with the annulus casting downstream end.

22. The apparatus of claim 19, the exhaust end of the casing positioned between alignment with the annulus casting downstream end, and about 5 percent of the annulus casting length downstream of the annulus casting downstream end.

23. The gas turbine combustor of claim 18, the baseplate comprising a plurality of high-flashback-occurrence zones adjacent to openings into which fit the downstream end of annulus castings of respective main swirler assemblies, each flashback annulus effective to reduce, in total area, regions of structural damage located in a respective high-flashback-occurrence zone.

* * * * *